US007096932B2

(12) United States Patent
Scoville et al.

(10) Patent No.: US 7,096,932 B2
(45) Date of Patent: Aug. 29, 2006

(54) MULTI-FLUID HEAT EXCHANGER AND METHOD OF MAKING SAME

(75) Inventors: David M. Scoville, Kenosha, WI (US); Ken Nakayama, Racine, WI (US); Richard T. Gebhard, South Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/743,362

(22) Filed: Dec. 22, 2003

(65) Prior Publication Data

US 2005/0133207 A1 Jun. 23, 2005

(51) Int. Cl.
*F28D 7/16* (2006.01)
*F28F 13/00* (2006.01)

(52) U.S. Cl. ..... 165/140; 165/176; 165/135; 165/70

(58) Field of Classification Search ..... 165/140, 165/135, 173–175, 177, 153, 916, 70, 176; 29/890.052

See application file for complete search history.

(56) References Cited

U.S. PATENT DOCUMENTS

| | | | | |
|---|---|---|---|---|
| 1,948,929 A | | 2/1934 | MacPherson | |
| 2,037,845 A | * | 4/1936 | Young | 165/139 |
| 2,264,820 A | | 12/1941 | Young | |
| 2,505,790 A | | 5/1950 | Panthofer | |
| 4,137,982 A | | 2/1979 | Crews et al. | |
| 4,651,816 A | | 3/1987 | Struss et al. | |
| 4,688,311 A | | 8/1987 | Saperstein et al. | |
| 4,923,001 A | | 5/1990 | Marcolin | |
| 4,947,931 A | | 8/1990 | Vitacco | |
| 5,009,262 A | | 4/1991 | Halstead et al. | |
| 5,036,910 A | | 8/1991 | Wolf | |

(Continued)

FOREIGN PATENT DOCUMENTS

| | | |
|---|---|---|
| EP | 0 789 213 | 8/1997 |

(Continued)

OTHER PUBLICATIONS

International Search Report dated May 17, 2005.

(Continued)

*Primary Examiner*—Tho Duong
(74) *Attorney, Agent, or Firm*—Wood, Philips, Katz, Clark & Mortimer

(57) ABSTRACT

A multi-fluid heat exchanger having separate fluid flow paths for two fluid streams to be heated or cooled by a third fluid stream includes first and second elongated, parallel tubular headers (10, 12), having opposed ends (14), generally uniformly spaced elongated tube slots (16) in each of the headers (10, 12) with the tube slots (16) in one header (10) facing-and aligned with the tube slots (16) and the other header (12), a plurality of flattened tubes (20) extending between the headers (10, 12) and having ends (22) received in aligned ones of the tube slots (16), one tube slot (24) in each header being unoccupied by any of the flattened tubes (20), the one tube slots (24) being aligned with each other and located at a predetermined location between the ends (14) of the headers (10, 12) and between two groups (A, B) of the flattened tubes (20) so there are two groups of the flattened tubes (20) on each side of the one tube slot (24), a pair of baffles (30) in each header (10, 12) with one on each side of the one tube slot (24) and fins (26, 32) extend between and are in heat transfer relation with at least the adjacent tubes (20) in each of the groups (A, B).

8 Claims, 1 Drawing Sheet

U.S. PATENT DOCUMENTS

| | | | | |
|---|---|---|---|---|
| 5,129,144 | A | 7/1992 | Halstead et al. | |
| 5,186,244 | A | 2/1993 | Joshi | |
| 5,186,246 | A | 2/1993 | Halstead | |
| 5,366,005 | A | 11/1994 | Kadle | |
| 5,720,341 | A | 2/1998 | Watanabe et al. | |
| 5,881,456 | A * | 3/1999 | Bergins et al. | 29/890.052 |
| 6,035,927 | A | 3/2000 | Krauss et al. | |
| 6,173,766 | B1 | 1/2001 | Nakamura et al. | |
| 6,321,832 | B1 | 11/2001 | Le | |
| 6,394,176 | B1 * | 5/2002 | Marsais | 165/140 |
| 2002/0040776 | A1 * | 4/2002 | Kokubunji et al. | 165/140 |

FOREIGN PATENT DOCUMENTS

| | | | |
|---|---|---|---|
| EP | 859209 | A1 * | 8/1998 |
| FR | 2 712 674 | | 11/1993 |
| FR | 2 712 674 | | 5/1995 |
| FR | 2 785 376 | | 5/2000 |
| GB | 2 377 268 | | 1/2003 |
| JP | 05272889 | A * | 10/1993 |
| JP | 09152296 | A * | 6/1997 |
| JP | 10-206074 | | 8/1998 |
| JP | 10141875 | | 8/1998 |
| JP | 11-153395 | | 6/1999 |

OTHER PUBLICATIONS

Written Opinion of the International Searching Authority dated May 17, 2005.

* cited by examiner

MULTI-FLUID HEAT EXCHANGER AND METHOD OF MAKING SAME

FIELD OF THE INVENTION

This invention relates to heat exchangers, and more specifically, to a multi-fluid heat exchanger wherein two or more different heat exchange fluids are heated or cooled by a third heat exchange fluid.

BACKGROUND OF THE INVENTION

Multi-fluid heat exchangers such as two or dual fluid heat exchangers have been known for a considerable period of time. One typical usage for such heat exchangers is in vehicular applications for cooling two different heat exchange fluids. However, they may also be used in other applications wherein one or both of the two fluids may be heated by a third fluid as well.

An early example of such a system intended for vehicular use is shown in U.S. Pat. No. 1,948,929 to Mac Pherson, issued Feb. 27, 1934. The Mac Pherson patent describes a dual fluid heat exchanger wherein part of the heat exchanger is used as a radiator to cool engine coolant while the remainder of the heat exchanger is utilized to cool a completely different type of fluid, namely, lubricating oil for an internal combustion engine.

A more recent example is found in the U.S. Pat. No. 6,394,176 to Marsais, granted May 28, 2002. In the Marsais patent, one fluid being cooled is a refrigerant for a vehicular air conditioning system while the other fluid is transmission lubricating oil.

In such systems, it is necessary to prevent intermingling of the two fluids being heated and/or cooled to prevent possible malfunction of the systems in which the systems are used. It is also highly desirable that such heat exchangers be of low volume and low weight, particularly when used in vehicular systems. Low volume minimizes spacial constraints on designers, allowing them to design aerodynamically "slippery" vehicles for enhanced fuel efficiency. Similarly, minimal weight also will improve fuel efficiency in a vehicle.

It is also highly desirable that such heat exchangers be inexpensive to fabricate and, in many instances, it is highly desirable to provide thermal isolation between that section of the heat exchanger dealing with one heat exchange fluid and the other section of the heat exchanger dealing with the second heat exchange fluid.

To achieve these goals, the above identified Marsais patent utilizes a heat exchanger employing tubular headers with a line tube receiving slots which in turn receive flattened tubes. Serpentine fins extend between adjacent ones of the tubes and are bonded thereto.

In one embodiment, to provide thermal isolation between the two sides of the heat exchanger, one of the tubes is a "dead tube" meaning that neither heat exchange fluid passes through it. In the headers, the dead tube is isolated, at each end, by two baffles which minimize heat transmission between the fluids in the headers. The present of the dead tube also minimizes heat transfer between the tubes via the fins customarily found in such heat exchangers.

One perceived difficulty in the fabrication of such a dual fluid heat exchanger resides in the possibility that if the heat exchanger is brazed during the fabrication process, the elevation of temperature may act upon gas within the dead tube and confined therein by the baffles, causing such gas to build up pressure and possibly cause minute leaks at the interface of one or more of the baffles and the corresponding header. If such leaks occur in baffles on opposite sides of the dead tube, the possibility of cross contamination exists. Moreover, there is no means by which any fluid that might leak into the space between the baffle can be readily discharged to avoid cross contamination.

SUMMARY OF THE INVENTION

It is the principal object of the invention to provide a new and improved multi-fluid heat exchanger.

It is an object of the invention to provide a multi-fluid heat exchanger that can minimize the possibility of the formation of leaks and baffled headers that could result in cross contamination of the two or more heat exchange fluids.

It is an object of the invention to provide a multi-fluid heat exchanger and a method of manufacturing the same that can be readily adaptable to present day assembly techniques and thus may not require modification of assembly lines.

An exemplary embodiment of the invention achieves at least one of the foregoing objects in a multi-fluid heat exchanger having separate flow paths for at least two fluid streams to be heated or cooled by a third fluid stream and which includes first and second elongated, spaced, parallel tubular headers having opposed ends. Spaced elongated tube slots are located in each of the headers with tube slots in one header facing and aligned with tube slots in the other header. A plurality of flattened tubes extend between the headers and have ends received in aligned ones of the tube slots. One tube slot in each header is unoccupied by one of the flattened tubes and the one tube slot in one header is aligned with the one tube slot in the other header and located at a predetermined location between the ends of the headers and between two groups of the flattened tubes so there are two groups of flattened tubes, one on each side of the one tube slot. A pair of baffles are located in each header, one on one side of the one tube slot and the other on the other side of the one tube slot. Fins extend between and are in heat transfer relation with at least the adjacent tubes in each of the two groups.

In a preferred embodiment, an additional fin is disposed in heat transfer relation with an end tube of each of the groups, with one of the end tubes being adjacent and on one side of the unoccupied tube slots and the other of the end tubes being adjacent and on the opposite side of the unoccupied tube slots.

In a preferred embodiment, all of the fins are serpentine fins and the additional fin has a fin height just greater than twice the fin height of the other fins. In a highly preferred embodiment, the second fin height is equal to about twice the first fin height plus the minor dimension of one of the tubes.

In one embodiment, a multi-fluid heat exchanger is provided having separate flow paths for at least two fluid streams to be heated or cooled by a third fluid stream. The multi-fluid heat exchanger includes first and second, elongated, spaced parallel tubular headers having opposed ends, with spaced, elongated tube slots in each of the headers with the tube slots in one header facing in aligned with the tube slots in the other header. The heat exchanger further include a plurality of flattened tubes extending between the headers and having ends received in aligned ones of the tube slots. A weep hole is provided in each of the headers, with the weep holes being aligned with each other and located at a predetermined location between the ends of the headers and between two groups of the flattened tubes. A pair of baffles are provided in each header, with one of the baffles being on one side of the weep hole and between and adjacent tube slot on the one side, and the other baffle located on the opposite side of the weep hole between an adjacent tube slot on the opposite side. First serpentine fins of a first fin height extends between and are bonded to the adjacent tubes in each of the two groups. A second serpentine fin of a second fin height greater than the first fin height extends between tubes in the adjacent tube slot on the one side and in the adjacent tube slot on the opposite side of the weep hole.

The invention also contemplates a method of making a multi-fluid heat exchanger which includes the steps of:

a. providing two elongated tubular headers with spaced, elongated tube slots extending generally transverse to the direction of the elongation of each of the headers;

b. selecting a tube slot for use as a weep hole in each header, with the weep hole tube slot in both headers being in identical positions and installing baffles in each header on both sides of the weep hole tube slots;

c. aligning the headers with their tube slots facing each other and with corresponding tube slots opposite one another;

d. forming a heat exchanger core by sandwiching serpentine fins in alternating relation with flattened tubes having ends dimensioned to be received in the tube slots with (i) all but one of the serpentine fins having a fin height approximately equal to the distance between adjacent tube slot and (ii) with the all but the one fin having a fin height approximately equal to the distance between two tube slots located to align with the weep hole tube slot;

e. fitting the headers to the core by causing the ends of the tubes to enter corresponding ones of said tube slots other than the weep hole tube slots;

f. compressing the core in the direction of the elongation of the header sufficiently to cause the crest of the fins to contact the tubes between which they are sandwiched and g. metallurgically bonding the tube ends within the tube slots and the serpentine fins to the tubes between which they are sandwiched.

In a preferred embodiment, step d precedes at least step c.

The invention also contemplates that step f precedes step e.

In one embodiment of the invention step b includes the step of forming baffle receiving slots in the header on both sides of the weep hole tube slots in each of the headers and inserting baffles into the baffle receiving slots.

In a highly preferred embodiment, the headers, the fins, the tubes and the baffles are formed of metal and step g is preceded by the step of locating a brazing compound at the interface of the headers and the tube ends and the baffle and the interface of the tubes and the fins. Further, step f is maintained during the performance of step g and step g is performed by subjecting the assemblage of resulting from step e to an elevated brazing temperature.

In a highly preferred embodiment, the metal is aluminum or its alloys.

In one form, a method is provided for making a multi-fluid heat exchanger for at least two fluids to be heated or cooled by a third fluid. The methods includes the steps of:

a) providing two elongated tubular headers with spaced, elongated tube slots extending generally transversed to the direction of the elongation of the header;

b) providing a weep hole in each header, with the weep hole in both headers being in identical positions and installing baffles in each header on both sides of the weep hole;

c) aligning the headers with their tube slots facing each other and with corresponding tube slots opposite one another;

d) forming a heat exchanger core by sandwiching serpentine fins in alternating relation with flattened tubes having ends dimensioned to be received in said tube slots, with one of said fins located to align with said weep holes to extend between a pair of tubes that will be received in tube slots located adjacent said baffles on opposite sides of the baffles from said weep holes, said one serpentine fin having a fin height greater than the other serpentine fins;

e) fitting the headers to the core by causing the ends of the tubes to enter corresponding ones of said tube slots;

f) compressing the core in the direction of the elongation of said headers sufficiently to cause the crest of the fins to contact the tubes between which they are sandwiched; and g) metallurgically bonding the tube ends within the tube slots and the serpentine fins to the tubes between which they are sandwiched.

Having described some of the objects of the invention and certain embodiments of the invention, it should be understood that not all embodiments of the invention will necessarily achieve all or any of the specifically described objects of the invention. Furthermore, other objects and advantages will become apparent from the following specification taken in connection with the accompanying drawings and claims.

DESCRIPTION OF THE PREFERRED EMBODIMENTS

An exemplary embodiment of a dual fluid heat exchanger will be described herein in the environment of a vehicular application wherein the heat exchanger serves as a condenser or gas cooler for a refrigerant in a vehicular air conditioning system as well as an oil cooler. However, it is to be expressly understood that the inventive heat exchanger is not limited to use in vehicular applications nor is it limited strictly to cooling operations. Also, it is not limited to use with two fluids such as refrigerants and oil, but may be utilized with a variety of other fluids as well. Similarly, in the embodiment illustrated, each of the two fluids make a single pass through the heat exchanger. However, multiple passes may be envisioned for certain uses and can be provided by various means known in the art as for example, baffling systems, particularly in one tube row heat exchangers for forming multiple row heat exchangers wherein different passes occur in different rows. No limitations to the specific preferred mode of use or fluids intended except insofar as expressly stated in the appended claims.

Figure 1:
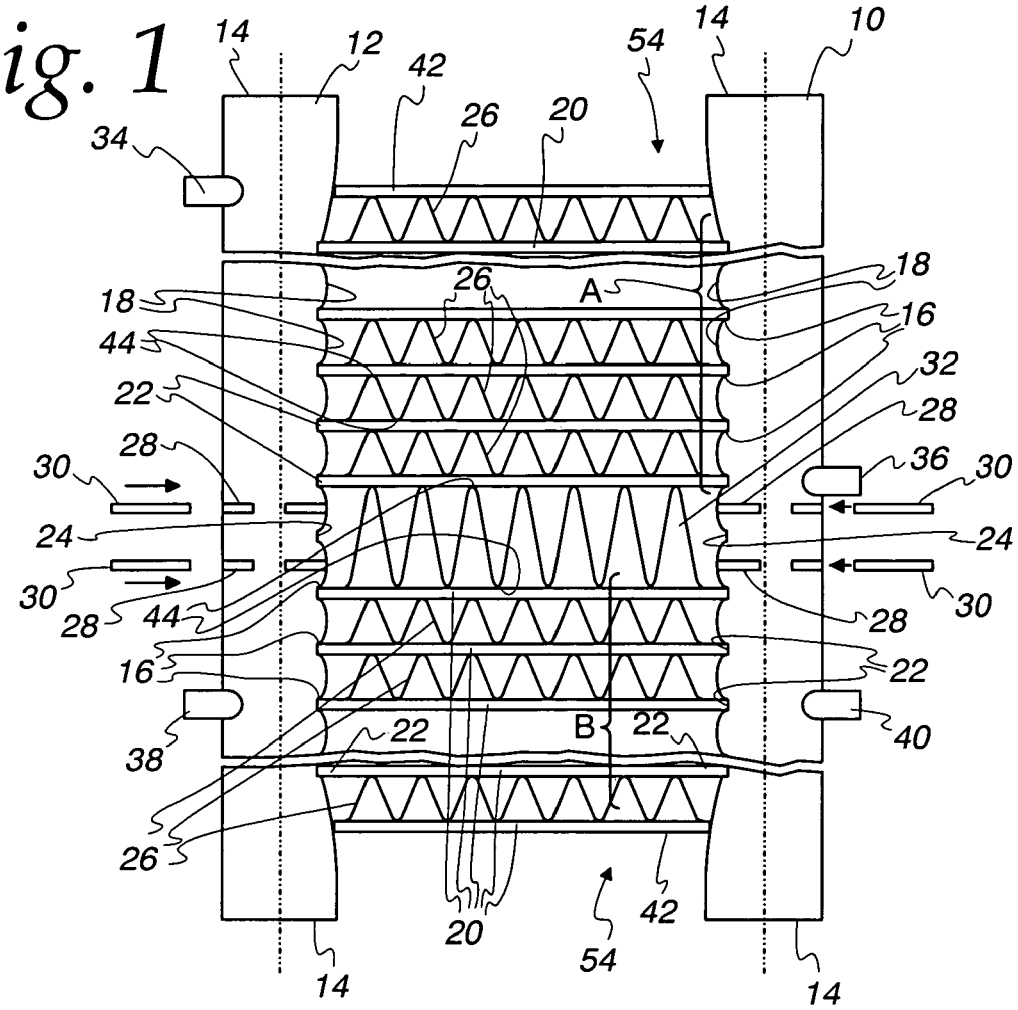
FIG. 1 is a somewhat schematic, fragmentary side elevation of a dual fluid heat exchanger made according to the invention.

With reference to FIG. 1, one embodiment of a multi-fluid heat exchanger made according to the invention is seen to include a pair of elongated headers, 10, 12. The headers 10, 12, are preferably tubular and even more preferably are generally cylindrical in shape. The ends 14 of the tubular headers 10, 12 are closed by any suitable means, as, for example, plugs or may be closed with inlet and/or outlet fittings as desired. Intermediate the ends 14, each header includes a plurality of tube slots 16. The tube slots 16 are elongated in a direction transverse to the direction of the elongation of the headers 10, 12 and are uniformly spaced from one another. Preferably, although not necessarily, pressure resistant domes 18 are located between each of the tube slots 16. Such domes 18 are well known in practice and an illustrative example of the same is illustrated in U.S. Pat. No. 4,615,385 issued Oct. 7, 1986 to Saperstein et al.

A plurality of flattened tubes 20 extend between the headers 10, 12 and have opposite ends 22 received in aligned ones of the tube slots 16. The tubes 20 are located with all of the tube slots 16 except for a tube slot 24 in each header which both serve as a weep hole for purposes to be seen.

Serpentine fins 26 of conventional construction are sandwiched between the tubes 20 in a conventional fashion and are in heat transfer relation therewith. Typically, this is accomplished by brazing the fins to the flattened side walls of the tubes 20 in a known manner as, for example, brazing although other metallurgic bonding technics such as soldering, could be used if desired.

On each side of each of the weep hole tube slots 24, baffle receiving slots 28 are formed in the headers 10, 12. The baffle receiving slots receive conventional baffles 30 which are brazed in place so as to seal the interior of each of the headers 10, 12 on both sides of the weep hole tube slots 24. As seen in FIG. 1, the baffle receiving slots 28 and baffles 30 are located between each of the weep hole tube slots 24 and the adjacent one of the tubes 20.

An additional serpentine fin 32 extends between two tubes 20 that are adjacent to each other and are immediately adjacent to a corresponding one of the baffles 30, that is between the two tubes centered about the weep hole tube slots 24.

The assembly is completed by inlet or outlet ports 34, 36 for a group A of the tubes 20 on one side of the weep hole tube slots 24 and a group B of tube slots of tube 20 on the opposite side of the weep hole tube slots 24. The tubes A are in fluid communication with the ports 34 and 36 while the tubes 20 in the group B are in fluid communication with inlet and/or outlet ports 38, 40 which open to the interior of the headers 10, 12 on the side of the weep hole tube slots 24 opposite the ports 34, 36. Finally, conventional side plate 42 extend between the headers 10, 12, adjacent their ends 14 and, with the tubes 20, sandwich the fins 26 and the additional fin 32 so that the crests 44 of the fins 26 and the additional fin 32 substantially abut the tubes 20, and at the ends of the heat exchanger, the side plates 42.

The components are all formed of metal and preferably, aluminum or aluminum alloys. A braze compound is located at the interface of the ports 34, 36, 38, 40, and the respective headers 10, 12 as well as at the interface of the tube ends 22 and the tube slots 16 and the interface of the baffles 30 with the headers 10, 12. Braze compound is also located at the interface of the serpentine fins 26 and the additional serpentine fin 32 and the tubes 20 or the side pieces 42 as the case may be. The braze compound preferably, but not necessarily, is present as a cladding.

From the foregoing, those skilled in the art will readily appreciate that the fluid flowing through the tubes of group B is double isolated from the fluid flowing through the tubes of group A and vice versa by the presence of two baffles 30 in each of the headers 10, 14. Moreover, to the extent that there may be leakage, such leakage may flow into the space between the baffles 30 and in either of the headers 10, 12 and exit the same at atmospheric pressure through the weep hole tube slots 24 to avoid any build up that could result in cross contamination.

Furthermore, build up of gas pressure between the baffles 30 during brazing is avoided by reason of the fact that there is no dead tube extending between the weep hole tube slots 24 so that the space between the baffles 30 and each of the headers 10 and 12 is at atmospheric pressure. Thus, leakage paths about the baffles 30 are far less prone to be formed.

One feature of the invention is that the tube slots 16, including the weep hole tube slots 24 can be uniformly spaced along the length of the headers 10, 12. In this case, conventional equipment for forming such tube slots need not be modified in fabricating the headers 10, 12. It is also important to recognize that the heat exchanger just described can be formed on conventional assembly lines. In particular, the serpentine fins 26 are formed with a fin height as equal to or ever so slightly greater than the distance between adjacent edges of adjacent tube slots 16. Further, the additional fin 32 is chosen to have a fin height that is equal to twice the fin height of the fins 26 plus the minor dimension of one of the tubes 20. Fin height is as conventionally defined and is equal to the distance between oppositely directly crests 44 of the fins 26 or 32. The minor dimension of the flattened tubes 20 is also conventionally defined, namely, the outside dimension of the tubes from one exterior flattened wall to the opposite exterior flattened wall.

In a preferred form of the invention, the tube slots 16 associated with the tubes 20 of group A are uniformly spaced within the group, and the tube slots 16 associated with the tubes 20 of group B are uniformly spaced within the group, but do not have the same spacing as the tube slots 16 associated with the tubes of group A. This allows the tubes 20 of group B to have a minor dimension that is different than the minor dimension of the tubes 20 of group A to accommodate the different requirements of the particular fluids flowing through the tubes 20 of groups A and B. In this case, the serpentine fins 26 for both the group A and group B tubes 20 can have the same fin height as long as the gaps between the tube 20 of the group A tubes is the same as the gaps between the tubes 20 of the group B tubes. Further, the height of the additional fin 32 will have a fin height that is dependent upon the spacing chosen between the weep hole tube slot 24 and the adjacent tube slots 16 associated with each of the groups A and B, as well as the minor dimension of the weep hole tube slot 24, but in any event the height of the additional fin 32 should be greater than the fin height of the remaining serpentine fins 26.

Furthermore, while it is not preferred, it should be understood that the weep hole tube slot 24 can be replaced with a simple weep hole that is not in the form of a tube slot but may be in the form of a simple circular drilled or punched hole, or a punched or machined hole having another geometric shape as may be conveniently formed.

Figure 2:
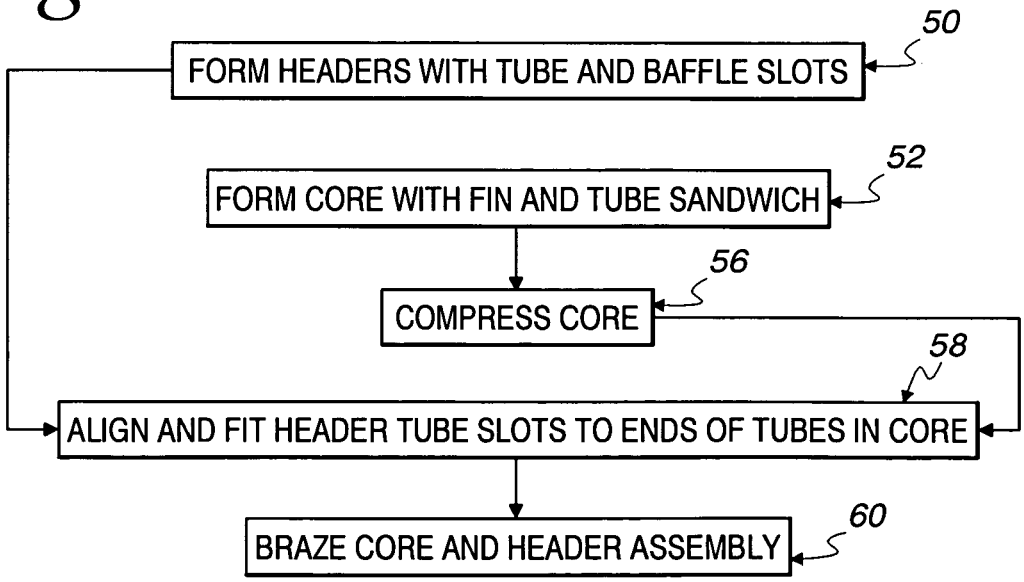
Fig. 2 (Prior Art)
FIG. 2 is a block diagram illustrating typical steps in a prior art method of assembly of a heat exchanger, which method is readily adapted to the manufacture of a heat exchanger such as shown in FIG. 1 as will be explained.

Thus, the invention may be fabricated easily using by and large conventional forming technics such as illustrated in FIG. 2. In FIG. 2, a first manufacturing step is to form the headers 10, 12 with the tube and baffle slots 16, 24, and 28, respectively. This is shown at a block 50. In addition, the heat exchanger core is conventionally formed by alternating, between the side plates 42, the serpentine fins 26 and the additional fin 32 with the tubes 20 so that the fins are sandwiched between the tubes 20 and the end plates 42. This is indicated at block 52.

The core is as conventionally defined, namely, the core is composed of the tubes 20, the side plates 42, if used, and the fins 26 and 32.

The core is then compressed in a direction indicated by arrows 54 (FIG. 1) to bring the crests 44 of the fins 26 and 32 into substantial abutment with the tubes 20 between which they are sandwiched as shown at block 56 in FIG. 2. By substantial abutment, it is meant that they are brought in sufficiently close proximity that any gap that might exist is readily closed by a metallurgical bond formed, as for example, by brazing compounds, solder, etc. The compression is such as to bring the tube ends 22 into a spacing corresponding to spacing between tube slots 16.

In forming the fin and tube sandwich, or core, it is important to properly locate the additional fin 32 so that, upon further assembly, the same will be in alignment with the weep hole tube slots 24 as illustrated in FIG. 1.

The headers 10, 12 may then be aligned with the ends of the tubes 20 and fitted thereon as shown at the block 58. In practice, this is accomplished in a conventional brazing fixture so that the proper alignment is maintained. The resulting assemblage, still in the brazing fixture, is then placed in a brazing oven or the like (block 60) and elevated to a brazing temperature whereat the brazing compound at the various interfaces mentioned previously will flow to bond and seal the interfaces of the various components.

It is important to note that the use of the additional fin 32 in alignment with the weep hole tube slots 24 provides for simplified processing. Firstly, as mentioned earlier, it allows for conventionally formed headers 10 and 12 to be employed. Secondly, the presence of the fin 32 allows the compression indicated by the arrows 54 which is necessary to ensure that the fins 26 and 32 bond to the tubes 20 to provide good heat transfer relationship between the fins and the tubes.

It is also particularly noted that because of the enlarged fin height of additional fin 32 in relation to the fin height of the fins 26, a good measure of thermal isolation is achieved between the tubes 20 of Group A and the tubes 20 of Group B. Firstly, the large fin height lengthens the path for heat transfer thereby providing an impediment in heat transfer from one tube 20 to the other as to the tubes 20 separated by the additional fin 32 in comparison tubes 20 separated by the fins 26 which have a lesser fin height. Secondly, the fact that the fin 32 is located in the stream of the cooling or heating fluids which typically will pass between the tubes 20 through the fins 26 and 32, between the headers 10 and 12, and because of its greater fin height, provides a greater tendency to assume the temperature of the heating or cooling fluid and thus isolate the end most tube 20 in group A at the end of the group opposite the side plate 42 of the end most tube 20 in group B opposite the side plate 42.

As an overall result, it will be appreciated that a multi-fluid heat exchanger made according to the invention can be economically fabricated in that it can require virtually no change or current manufacturing technics except for the use of the additional fin 32 and the omission of a dead tube that would ordinarily extend between the weep hole tube slots 24.

Further, the tendency of gas pressure build up during brazing and causing leaks between the headers 10, 12 at the baffles 30 is avoided altogether. Good thermal isolation is still maintained through the use of the additional fin 32.

While a preferred form of the multi-fluid heat exchanger according to the invention has been described above in the form of a two or dual fluid heat exchanger suitable for use with two fluids flowing through the respective tube groups A and B, it should be understood that heat exchangers according to the invention can be made to accommodate two or more fluids, with an additional group of tubes beyond the A and B groups for each additional fluid stream above two. In this regard, the weep hole tube slot 24 (or substitute weep hole), baffles 20, and additional fin 32 could be repeated between each adjacent group of tubes for the different fluid streams, or a single baffle with or without a weep hole and/or additional fin 32 could be provided between adjacent groups of tubes if there is a lower concern for cross-contamination and/or heat transfer between the two fluid streams flowing through the adjacent groups of tubes. Accordingly, no limitation to a two or dual fluid heat exchanger is intended unless expressly recited in the claims.

We claim:

1. A multi-fluid heat exchanger having separate flow paths for at least two fluid streams to be heated or cooled by a third fluid stream, comprising:

first and second, elongated, spaced, parallel tubular headers having opposed ends;

spaced elongated tube slots in each of said headers with the tube slots in one header facing and aligned with the tube slots in the other header;

a plurality of flattened tubes extending between said headers and having ends received in aligned ones of said tube slots;

one of said tube slots in each header being unoccupied, said one of said tube slots in each header being aligned with each other and located at a predetermined location between the ends of said headers and between two groups of said flattened tubes, a pair of baffles in each header, one on one side of said one tube slot and between said one tube slot and the adjacent tube slot on said one side and the other on the opposite side of said one tube slot and between said one tube slot and the adjacent tube slot on said opposite side; and fins extending between and in heat transfer relation with at least the adjacent tubes in each of said two groups.

2. The multi-fluid heat exchanger of claim 1 further including an additional fin in heat transfer relation with an end tube in each of said two groups, one of said end tubes being in said adjacent tube slots on said one side and the other of said end tubes being in said adjacent tube slots on said opposite side.

3. The multi-fluid heat exchanger of claim 2 wherein all said fins are serpentine fins and said additional fin has a fin height just greater than twice the fin height of the other fins.

4. The multi-fluid heat exchanger of claim 1 wherein the tube slots associated with one of said two groups are generally uniformly spaced as a group in each of said headers and the tube slots associated with the other of said two groups are generally uniformly spaced as a group in each of said headers.

5. A multi-fluid heat exchanger having separate flow paths for two fluid streams to be heated or cooled by a third fluid stream, comprising:

first and second, elongated, spaced, parallel tubular header having opposed ends;

spaced elongated tube slots in each of said headers with the tube slots in one header facing and aligned with the tube slots in the other header;

a plurality of flattened-tubes extending between said headers and having ends received in aligned ones of said tube slots;

a weep hole in each header, said weep holes in the headers aligned and facing each other and located at a predetermined location between the ends of said headers and between two groups of said flattened tubes;

a pair of baffles in each header, one on one side of said weep hole and between said weep hole and an adjacent tube slot on said one side and the other on the opposite side of said weep hole and between said weep hole and an adjacent tube slot on said opposite side;

first serpentine fins of a first fin height extending between and bonded to the adjacent tubes in each of said two groups; and a second serpentine fin of a second fin height greater than said first fin height extending between tubes in said adjacent tube slot on said one side and in said adjacent tube slot on said opposite side.

6. The multi-fluid heat exchanger of claim 5 wherein said second fin height is equal to about twice the first fin height plus the minor dimension of one of said tubes.

7. The multi-fluid heat exchanger of claim 5 wherein the tube slots associated with one of said two groups are generally uniformly spaced as a group in each of said headers and the tube slots associated with the other of said two groups are generally uniformly spaced as a group in each of said headers.

8. A multi-fluid heat exchanger having separate flow oaths for two fluid streams to be heated or cooled by a third fluid stream, comprising:

first and second, elongated, spaced, parallel tubular header having opposed ends;

spaced elongated tube slots in each of said headers with the tube slots in one header facing and aligned with the tube slots in the other header;

a plurality of flattened tubes extending between said headers and having ends received in aligned ones of said tube slots;

a weep hole in each header, said weep holes in the headers being aligned each other and located at a predetermined location between the ends of said headers and between two groups of said flattened tubes;

a pair of baffles in each header, one on one side of said weep hole and between said weep hole and an adjacent tube slot on said one side and the other on the opposite side of said weep hole and between said weep hole and an adjacent tube slot on said opposite side;

first serpentine fins of a first fin height extending between and bonded to the adjacent tubes in each of said two groups;

a second serpentine fin of a second fin height greater than said first fin height extending between tubes in said adjacent tube slot on said one side and in said adjacent tube slot on said opposite side; and wherein said weep hole is provided in the form of one of said tube slots in each said header, said one tube slot being unoccupied by any of said flattened tubes.

* * * * *